US010522128B2

(12) United States Patent
Bellizzi et al.

(10) Patent No.: US 10,522,128 B2
(45) Date of Patent: Dec. 31, 2019

(54) SOUND ATTENUATION DEVICE AND METHOD

(71) Applicants: CENTRE NATIONAL DE LA RECHERCHE SCIENTIFIQUE, Paris (FR); UNIVERSITE D'AIX-MARSEILLE, Marseilles (FR); ECOLE CENTRALE DE MARSEILLE, Marseilles (FR)

(72) Inventors: Sergio Bellizzi, Marseilles (FR); Bruno Cochelin, Plan de Cuques (FR); Renaud Cote, Digne les Bains (FR); Philippe Martin Herzog, Roquevaire (FR); Pierre-Olivier Mattei, Marseilles (FR); Marc Pachebat, Marseilles (FR); Cedric Pinhede, Marseilles (FR)

(73) Assignees: UNIVERSITE D'AIX-MARSEILLE, Marseilles (FR); CENTRE NATIONAL DE LA RECHERCHE SCIENTIF, Paris (FR); ECOLE CENTRALE DE MARSEILLE, Marseilles (FR)

( * ) Notice: Subject to any disclaimer, the term of this patent is extended or adjusted under 35 U.S.C. 154(b) by 370 days.

(21) Appl. No.: 15/324,286

(22) PCT Filed: Jul. 9, 2015

(86) PCT No.: PCT/EP2015/065678

§ 371 (c)(1),
(2) Date: May 4, 2017

(87) PCT Pub. No.: WO2016/005489

PCT Pub. Date: Jan. 14, 2016

(65) Prior Publication Data

US 2017/0249933 A1 Aug. 31, 2017

(30) Foreign Application Priority Data

Jul. 10, 2014 (FR) ..... 14 56686

(51) Int. Cl.
*G10K 11/178* (2006.01)
*G10K 11/16* (2006.01)
(Continued)

(52) U.S. Cl.
CPC ..... *G10K 11/178* (2013.01); *F02M 35/1255* (2013.01); *G10K 11/002* (2013.01);
(Continued)

(58) Field of Classification Search
CPC .... G10K 11/172; G10K 11/161; G10K 11/00; G10K 11/175; G10K 2210/1282;
(Continued)

(56) References Cited

U.S. PATENT DOCUMENTS 4,665,549 A * 5/1987 Eriksson ..... G10K 11/178 381/71.5
5,229,556 A * 7/1993 Geddes ..... F01N 1/065 181/206
(Continued)

FOREIGN PATENT DOCUMENTS

EP 2 172 640 4/2010

OTHER PUBLICATIONS

International Search Report for corresponding International PCT application No. PCT/EP2015/065678.
(Continued)

*Primary Examiner* — Forrest M Phillips
(74) *Attorney, Agent, or Firm* — Hauptman Ham, LLP

(57) ABSTRACT

An attenuation device for attenuating sound waves, and a corresponding system and method, generated by a source emitting sound waves having frequencies between f1 and f2
(Continued)

and wherein the pressure levels are between n1 and n2. The attenuation device comprising at least one acoustic absorber comprising at least one non-linear membrane; the attenuation device being configured in such a way that the first face of the absorber is in acoustic communication with the source. The attenuation device also comprises at least one coupling element for coupling the second face with the source, the coupling element being configured to transmit to the second face sound waves according to the sound waves emitted by the source, and of which the phase and/or the amplitude leads to a pressure differential of the sound waves arriving respectively on the first and second face at the same time.

34 Claims, 11 Drawing Sheets

(51) Int. Cl.
*G10K 11/175* (2006.01)
*F02M 35/12* (2006.01)
*G10K 11/00* (2006.01)

(52) U.S. Cl.
CPC ..... *G10K 11/161* (2013.01); *G10K 11/175* (2013.01); *F02M 35/125* (2013.01); *F02M 35/1266* (2013.01); *F02M 35/1272* (2013.01); *G10K 2210/1282* (2013.01); *G10K 2210/3219* (2013.01)

(58) Field of Classification Search
CPC ..... G10K 2210/3219; F02M 35/1255; F02M 35/125; F02M 35/1266; F02M 35/1272
USPC ..... 181/212
See application file for complete search history.

(56) References Cited

U.S. PATENT DOCUMENTS 5,319,165 A 6/1994 Geddes
6,353,670 B1 * 3/2002 Gasner ..... H04R 1/288 381/59
6,758,304 B1 * 7/2004 McLean ..... F02M 35/125 123/184.57
6,996,242 B2 * 2/2006 McLean ..... F02M 35/14 381/71.4
7,293,627 B2 * 11/2007 Kruger ..... F01N 1/006 181/206
7,533,759 B2 * 5/2009 Krueger ..... F01N 1/065 181/206
8,381,871 B1 2/2013 Hellie
8,485,309 B2 * 7/2013 Busse ..... B64D 33/06 181/206
9,066,168 B2 * 6/2015 Peitz ..... H04R 1/00
9,286,882 B1 * 3/2016 Polakowski ..... G10K 11/175
9,374,632 B2 * 6/2016 Krueger ..... F02M 35/125
9,394,812 B2 * 7/2016 McNelis ..... F01N 1/02
9,706,295 B2 * 7/2017 Pommerer ..... H04R 3/002
9,728,176 B2 * 8/2017 Keck ..... G10H 5/10
9,997,152 B2 * 6/2018 Nicolai ..... F01N 1/166
2006/0037808 A1 * 2/2006 Kruger ..... F01N 1/006 181/206
2007/0163533 A1 * 7/2007 Nakayama ..... F02M 35/125 123/184.57

OTHER PUBLICATIONS

Bellet, R., et al., "Experimental study of targeted energy transfer from an acoustic system to a nonlinear membrane absorber", Journal of Sound & Vibration, London, GB, vol. 329, No. 14, Feb. 18, 2010 (Feb. 18, 2010), pp. 2768-2791, XP026953546, ISSN: 0022-460X.

Mariani, et al., "Toward an adjustablenonlinear low frequency acoustic absorber," Journal of Sound and Vibration, vol. 330, No. 22, Jul. 8, 2011 (Jul. 8, 2011) , pp. 5245-5258, XP055183784, ISSN: 0022-460X.

Bellet, R., et al., "Enhancing the dynamic range of targeted energy transfer in acoustics using several nonlinear membrane absorbers," Journal of Sound & Vibration, vol. 331, No. 26, Sep. 3, 2012 (Sep. 3, 2012), pp. 5657-5668, XP028941027, ISSN: 0022-460X.

* cited by examiner

SOUND ATTENUATION DEVICE AND METHOD

TECHNICAL FIELD OF THE INVENTION

The invention relates to the field of attenuating sounds. It in particular relates to a device making it possible to attenuate the sounds generated by a source. It has for example for particularly advantageous application, without this being a limitation, the field of attenuating mouth noises of a combustion engine.

PRIOR ART

There are many solutions for attenuating the sounds generated by a source.

Several of these solutions are based on the use of a flexible membrane of which a face is set into movement by the sound. When the movements of the membrane correspond to an energy pumping effect, the sound is attenuated.

The energy pumping by membrane is of proven effectiveness when a face of the membrane is coupled with the source emitting the sounds and another face of the membrane is left free.

However leaving a face of the membrane free generates secondary sound radiation that is propagated towards the exterior and which substantially limits the interest of the attenuation device.

For this reason in particular, the attenuation device is in practice housed in part at least in a cover.

Covering the free face of the membrane then cuts off the secondary sound radiation but negatively disturbs the free deformation of the front face of the membrane. Indeed, the cover imprisons a volume of air that opposes the movement of the membrane.

A cover of very large volume can make it possible to avoid this opposition to the free displacement of the membrane but poses obvious problems of encumbrance.

A small cover has two disadvantages: in the case of a variation in the static pressure, an undesirable swelling of the membrane is produced; the volume of air imprisoned opposes the movements, in particular those at the frequency of the source.

In order to limit the encumbrance of the attenuation device and the emission of a secondary radiation a partial solution was described in the document published under number EP2172640. This solution is based on a membrane of which the rear face is enclosed in a cover in order to define an energy dissipation chamber. The energy dissipation chamber is provided with a pipe having substantial inertia and absorption in order to equalise the average pressures present on either side of the membrane in such a way as to prevent the appearance of an additional stress on the membrane, with this additional stress being detrimental to the operation of the system. The effectiveness of this solution is in practice limited.

In order to limit the encumbrance of the attenuation device and the emission of a secondary radiation another solution was described in the thesis of Chiu Yu Him, "Noise Attenuation by vibroacoustic coupling", The Hong Kong Polytechnic University, 2004. This solution is based on a magnetic system that offsets the overpressure generated between the cover and the rear face of the membrane during the deformation of the latter.

This solution aims as such to offset the acoustic phenomena generated in the rear chamber. This solution is in practice very complex to implement.

There is therefore a need that consists in proposing a solution for attenuating the sound of a primary source in a more effective manner than the known solutions and while still having a limited complexity for implementation and encumbrance.

Such is the objective of this invention.

SUMMARY OF THE INVENTION

In order to reach this objective, as aspect of this invention relates to an attenuation device intended for attenuating sound waves generated by a source emitting sound waves of which the frequencies are between f1 and f2 and of which the pressure levels are between n1 and n2, with the attenuation device comprising at least one sound absorber comprising at least one membrane, the sound absorber having at least one first face and at least one second face separate from the first face, with the sound absorber being configured to have a behaviour in non-linear deformation when it receives sound waves of which the frequencies are between $f_0 1$ and $f_0 2$, with the range $f_0 1$-$f_0 2$ covering at least 50% of the range f1-f2 and of which the pressure levels are between $n_0 1$ and $n_0 2$, with the range $n_0 1$-$n_0 2$ covering at least 50% of the range n1-n2;

with the attenuation device being configured in such a way that the first face of the absorber is in acoustic communication with the source.

Advantageously, the attenuation device comprises at least one coupling element for coupling the second face with the source, with the coupling element being configured to transmit to the second face sound waves such that $|P1-P2| > k \cdot |P1|$ during at least one portion of the operating cycle of the source, with P1 and P2 being the instantaneous acoustic pressures of the sound waves arriving respectively on the first and second faces at the same time and with k>0.2. and |P| the absolute value of P P1 and P2 are here instantaneous acoustic pressures, which can be measured in practice. |P1−P2| represents the absolute value of P1−P2 and |P1| represents the absolute value of the instantaneous pressure P1.

The device of the invention as such provides to acoustically couple each one of the two faces of the absorber to the source. It as such makes it possible to use the second face of the absorber by coupling it acoustically or electro-acoustically with the source.

The attenuation device is arranged in such a way as to impose a path difference between the sound waves arriving respectively on the first and second faces of the absorber, as such resulting in increasing the pressure differential that is applied on these two faces.

Each one of the two faces of the membrane is used and participates in the energy pumping.

The invention makes it possible as such to effectively attenuate sounds in a wide range of frequencies and all while retaining a reduced encumbrance.

The invention uses the rear face instead of being subjected to a disadvantage of it. The invention as such turns away from known solutions based on the formation of a dissipation chamber in the rear face of the membrane.

The invention makes it possible to use a cover, forming a chamber, with limited encumbrance without however the secondary radiation opposing the deformation of the membrane, and this advantageously regardless of the situations.

The solution described in document EP2172640 aims to establish a balancing of the static pressures on either side of the membrane, without transmitting acoustic phenomena at the rear face of the membrane The acoustic phenomena are suppressed by the pipe and are not felt. Indeed, the pipe has great inertia and dissipation which prevents it from transmitting sound waves (rapid vibrations). As such, the effectiveness of the attenuation is low as the inertia of the pipe of great inertia aims to equalise the static pressures and the dissipation chamber equipped as such prevents an optimum deformation of the membrane.

The invention aims, on the contrary, to accentuate and favour the instantaneous acoustic pressure difference between the two faces of the absorber in order to make use of the two faces of the membrane. If the membrane moves it is because there is a difference in pressure and the invention aims to increase this difference. For this, the rear face of the membrane is coupled acoustically to the source and not only balanced in pressure with the front face of the membrane. The sound waves can therefore reach the second face of the membrane and favour the dissipation mechanisms.

This invention aims to accentuate a difference in instantaneous acoustic pressure between the two faces of the absorber in order to use the two faces of the membrane and to optimise the attenuation of sound. In the invention, the coupling element between the source and the rear face has a transmission maximum for a frequency higher than f1.

The invention does not provide to form a dissipation chamber at the rear face of the membrane as disclosed in the solutions described in EP2172640 but it provides on the contrary to form a coupling chamber between the rear face of the membrane and the source.

As such, although the state of the art suggests to those skilled in the art to suppress, reduce or offset the acoustic phenomena generated between the rear face and the cover, the invention provides to make use of these phenomena and to adapt them to use both faces of the membrane.

The known solutions would therefore have turned away those skilled in the art from the invention.

Moreover, the device of the invention has a limited complexity.

According to another aspect, this invention relates to a system comprising a source emitting sound waves of which the frequencies are between f1 and f2 and of which the pressure levels are between n1 and n2 and an attenuation device according to the invention configured to attenuate the sound waves of said source.

According to another aspect, this invention relates to an attenuation method intended for attenuating sound waves generated by a source emitting sound waves of which the frequencies are between f1 and f2 and of which the pressure levels are between n1 and n2;

selecting at least one sound absorber comprising at least one membrane, with the sound absorber having at least one first face and at least one second face separate from the first face and more preferably opposite the latter, with the sound absorber being configured in such a way that the membrane has a behaviour in non-linear deformation when it receives sound waves of which the frequencies are between $f_o1$ and $f_o2$, with the range $f_o1$-$f_o2$ covering at least 50% of the range f1-f2 and of which the pressure levels are between $n_o1$ and $n_o2$, with the range $n_o1$-$n_o2$ covering at least 50% of the range n1-n2;

arranging the first face of the absorber in acoustic communication with the source;

selecting a coupling element for coupling the second face with the source, the coupling element being selected in such a way as to transmit to the second face a maximum of instantaneous acoustic pressure for sound waves of which the frequencies are higher than f1 and in such a way as to transmit the second face of sound waves of which:

the instantaneous acoustic pressure being exerted on the second face is according to the instantaneous acoustic pressure of the sound waves emitted by the source, the properties, of phase and/or of amplitude for example results in that $|P1-P2|>k\cdot|P1|$ during at least one portion of the operating cycle of the source, with P1 and P2 being the instantaneous acoustic pressures of sound waves arriving respectively on the first and second faces at the same time and with $k>0.2$.

According to another aspect, this invention relates to a method for attenuating noise generated by a source, with method characterised in that it comprises the following steps:

determining the acoustic mode or modes of noise;

selecting at least one sound absorber comprising at least one membrane, with the sound absorber having at least one first face and at least one different second face and often opposite the first face, with the electing of the absorber relating to at least one physical characteristic of the flexible membrane according to the acoustic mode or modes, fastening the membrane in such a way that the membrane can be subjected to a substantial deformation under the action of the acoustic mode or modes, said physical characteristic of the membrane being for example stiffness, which depends on the thickness, the surface and the Young's modulus of the membrane;

arranging the first face of the absorber in acoustic communication with the source;

coupling the second face with the source in such a way as to transmit to the second face a maximum of acoustic pressure for sound waves of which the frequencies are higher than the minimum frequency emitted by the source and in such a way as to transmit to the second face sound waves such that an instantaneous acoustic pressure differential is created on either side of the first and second faces of the absorber.

BRIEF DESCRIPTION OF THE FIGURES

The purposes, objects, as well as the characteristics and advantages of the invention shall appear better in the detailed description of an embodiment of the latter which is illustrated by the following accompanying drawings wherein.

Figure 1:
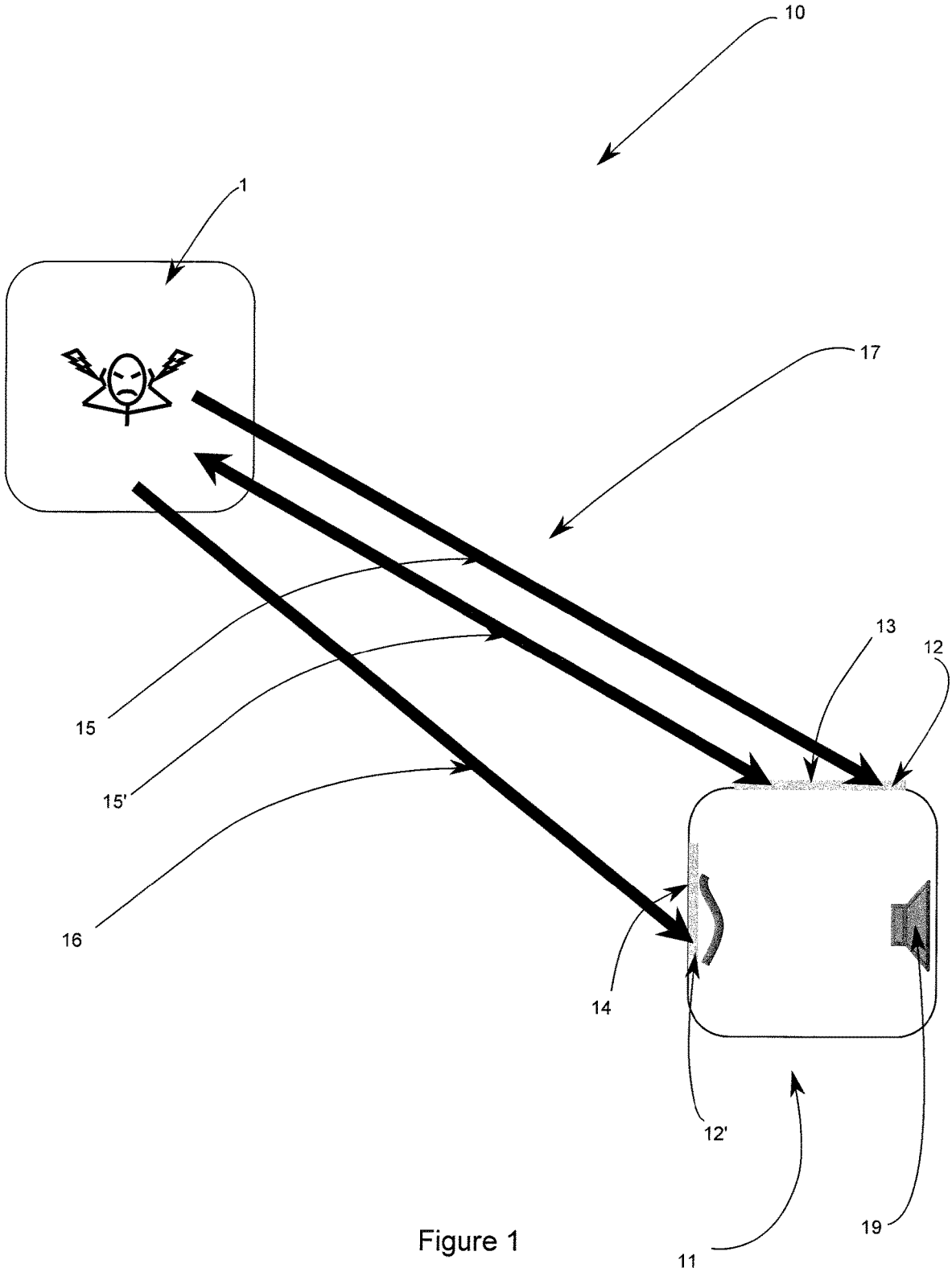
FIG. 1 is a diagram of an example of an embodiment of the invention.

The drawings are given by way of examples and do not limit the invention. They form diagrammatical block diagrams intended to facilitate the understanding of the invention and are not necessarily to the scale of the practical applications. In particular the dimensions relative to the different elements do not represent reality.

DETAILED DESCRIPTION OF THE INVENTION

Before describing embodiments of this invention in detail, a few reminders and definitions are provided hereinbelow concerning pressures as well as their levels:

Pressure is an instantaneous physical magnitude that can be broken down into two additive components, static pressure and instantaneous acoustic pressure.

Static pressure can be defined as the mathematical average of the pressure during the considered interval of time, an interval that is typically about at least 10 periods of the smallest frequency of interest, for example 0.2 s for 50 Hz. Instantaneous acoustic pressure represents the pressure component that calls into play acoustic phenomena, typically above 20 Hz.

Instantaneous acoustic pressure has an alternating of positive and negative values, and a zero average.

The term pressure level is used to refer to the average of the instantaneous acoustic pressure in terms of least squares (effective value). In the general case it is estimated from data connected in the same type of time interval as hereinabove. In this invention, the pressure level is noted as "n".

In the case of harmonic waves the amplitude of the wave is defined as the maximum value taken by the pressure component at the frequency considered. In the general case the amplitude is the maximum value taken by the instantaneous acoustic pressure. There is a proportional relationship between the amplitude and the level for harmonic waves or waves of a known shape. For any given signal, there is a quadratic relationship between its level, and the amplitudes of its Fourier components.

The following method can for example be used to determine the instantaneous acoustic pressures P1 and P2 that are exerted on the first and second faces of the absorber: placing microphones adapted to the target frequencies and pressure levels, ideally in the vicinity of the centre of the membranes at an axial distance of about d, such that $$d = \frac{\sqrt{\text{surface of the membrane}}}{\pi}$$

and in any case a distance inferior to a tenth of wavelength associated with f2.

In order to determine the pressure levels n1 and n2 it is possible for example to use any device that can calculate the effective value in a range of frequencies comprising at least the range ranging from f1 to f2. It is for example possible to use an analyser connected to the microphones placed according to the description hereinabove.

The invention provides to form an acoustic coupling between the rear face of the absorber and the source so as to use the instantaneous acoustic pressure at the rear face of the membrane in addition to using the front face of the absorber. The invention as such turns away from known solutions based on the forming of a dissipation chamber at the rear face of the membrane. Indeed, in the framework of the development of this invention it has been observed that in a solution with or without a duct with great inertia that equalises pressure, the volume of air imprisoned in the rear chamber opposes the movement of the membrane and hinders the attenuation of the sound.

More precisely, the attenuation device comprises at least one sound absorber configured to have a behaviour in non-linear deformation when it receives sound waves of which the frequencies are included in a wide range of frequencies and pressures emitted by the source. The sound absorber allows for a transmission of pressure and of flow rate.

The first face of the absorber is in acoustic communication, i.e. it allows for a transmission of pressure with the source. Furthermore the attenuation device comprises at least one coupling element for coupling the second face with the source. The coupling element is configured to transmit to the second face sound waves of which the instantaneous pressure is according to the instantaneous pressure of the sound waves emitted by the source. Advantageously, the coupling element is configured to create a path difference between the waves arriving at the same time on the first and second faces of the membrane in order to generate and favour a difference in instantaneous pressure between these faces of the absorber.

The device of the invention as such provides to acoustically couple both faces of the absorber. It as such makes it possible to use the second face of the absorber by coupling it acoustically or electro-acoustically with the source. The invention as such makes it possible to effectively attenuate sounds in a wide range of frequencies and with still retaining a reduced encumbrance.

Before starting a detailed review of the embodiments of the invention, optional characteristics that can possibly be used in combination or alternatively are mentioned hereinafter:

Preferably, the coupling element is configured to transmit to the second face sound waves of which the phase and/or the amplitude results in that $|P1-P2| > k \cdot |P1|$ during at least one portion of the operating cycle of the source, with P1 and P2 being the instantaneous pressures of the sound waves arriving respectively on the first and second faces at the same time and with $k>0.5$ and preferably $k>1$. $|P1-P2|$ is the absolute value of P1−P2 and $|P1|$ is the absolute value of P1.

Advantageously, $k>1.5$, preferably $k>1.8$, preferably $k>2$.

Advantageously, the coupling element is configured to transmit to the second face sound waves of which the instantaneous pressure that is exerted on the second face is according to the instantaneous pressure of the sound waves emitted by the source.

Advantageously, the coupling element is configured to transmit to the second face a maximum of instantaneous acoustic pressure for sound waves of which the frequencies are higher than f1.

Advantageously, at least one membrane is configured in such a way as to have a behaviour in non-linear deformation when it receives sound waves of which the frequencies are between $f_0$1 and $f_0$2, with the range $f_0$1-$f_0$2 covering at least 70% and preferably 100% of the range f1-f2.

It is possible for example to use the following method in order to determine if a membrane is non-linear in terms of the preceding description: The membrane has a non-linear deformation when, subjected to a harmonic excitation at a frequency chosen between f1 and f2 and a level chosen between n1 and n2, it is possible to detect in the vicinity a response containing terms at frequencies different from that of the excitation.

Advantageously, said second face is opposite said first face.

Advantageously, the at least one coupling element for coupling the second face with the source is configured to transmit to the second face sound waves of which the phase and/or the amplitude results in that $|P1-P2| > k \cdot |P1|$ during at least X % of the operating cycle of the source, with X=10. According to an embodiment, X=30.

According to an embodiment, the sound absorber has a linear resonance frequency $f_{rl}$, with $f_{rl}$<f1. As such the sound absorber, typically a membrane, has a linear resonance frequency strictly lower than the minimum frequency to be attenuated.

If the sound absorber comprises several membranes, then each membrane has a linear resonance frequency strictly lower than the minimum frequency to be attenuated.

The membrane or membranes of the acoustic absorber, by having a linear resonance frequency $f_{rl}$, with $f_{rl}$<f1 and by having a behaviour in non-linear deformation when it receives sound waves of which the frequencies are between $f_0$1 and $f_0$2, with the range $f_0$1-$f_0$2 covering at least 50% of the range f1-f2, makes it possible to generate the phenomenon of energy pumping, which results in a particularly effective attenuation of the noise of the source.

According to an embodiment, the at least one coupling element for coupling the second face with the source is configured in such a way that the membrane reaches the state of acoustic pumping, preferably at least when the range of frequencies transmitted by the coupling element is for a portion higher than the frequency $f_0$1 and preferably higher than $f_0$2.

According to an embodiment, the at least one coupling element for coupling the second face with the source is configured in such a way that at a given instant the acoustic system comprising the membrane reaches a state that can trigger the acoustic pumping, which is reached for example, in a non-limiting manner, by adding a noise at different frequencies of the range of frequencies of interest during a limited time (see Côte et al. JSV 333 (2014) 5057-5076).

When the range of frequencies transmitted by the coupling element is for a portion higher than the frequency $f_0$2, the signal transmitted by the coupling element contributes to the triggering of the sought absorption regime, and the noise generated or transmitted at high frequencies can easily be attenuated by conventional systems such as porous sorbents. The action of the coupler can be verified by measuring an increase in the sound level when the coupling is interrupted, for example by the inserting of a rigid wall, or by detecting a change in the non-linear mode (characterised by its stationarity, its spectrum, and where applicable the amplitudes and phases of its components). The design of the coupler can be verified by measuring its transfer function. The latter must show a maximum of transmission for frequencies higher than f1.

According to an embodiment, the acoustic coupling element, for example a duct or an acoustic pipe, comprises at least one internal wall and at least one acoustically absorbent element arranged on the internal wall.

Advantageously, the acoustically absorbent elements are configured to absorb in part at least the high frequencies produced by the source and/or by the attenuation device, for example 30% or 10% of the highest frequencies produced by the source and/or by the attenuation device.

According to an embodiment, the at least one acoustically absorbent element is glass wool.

Advantageously, the coupling element for coupling the second face with the source comprises at least one acoustic duct. According to a non-limiting embodiment, the device comprises a cover forming with said second face a closed volume with the exception of an opening formed by said at least one acoustic duct. According to another embodiment, said second face is housed in said at least one acoustic duct.

According to an embodiment the coupling element for coupling the second face with the source is free of an electro-acoustic coupler. As such the coupling element for coupling the second face with the source does not comprise any electro-acoustic coupler.

Advantageously, the coupling element for coupling the second face with the source comprises at least one electro-acoustic coupler. Advantageously, at least one membrane is a loudspeaker membrane, with an external face of the membrane being said first face. Advantageously, the absorber is configured in such a way that the loudspeaker receives an electric signal according to an acoustic signal from the source.

According to an embodiment, the absorber comprises a microphone arranged to capture sound waves coming from the source and is configured in such a way that that said acoustic signal is provided by the microphone. Preferably, the device comprises a cover defining with said second face a closed volume except for a capillary for balancing the instantaneous pressures in said first face and said second face.

Alternatively, the absorber is configured in such a way that said acoustic signal is taken on the second face of the membrane. Preferably, the device comprises a cover defining with said second face a closed volume except for a duct forming an acoustic coupling between said second face and the source.

The cover forms a chamber, also designated as dissipation chamber. Preferably it defines a closed volume except for one or several passages provided for the couplers.

The attenuation device comprises a plurality of coupling elements of the second face with the source.

Advantageously, the attenuation device is configured in such a way as to allow for a bi-directional communication between the source and said first face of the absorber.

According to an embodiment, the attenuation device is configured in such a way that the acoustic communication between the source and said first face of the absorber is a direct acoustic coupling, more preferably without any intermediary element for transmitting sound. That is to say, only through the volume of the enclosure wherein the source is arranged. According to another embodiment, the attenuation device is configured in such a way that the acoustic communication between the source and said first face of the absorber is an acoustic coupling carried out at least partially by one or several acoustic ducts. Preferably, the attenuation device is configured in such a way that the acoustic communication between the source and said first face of the absorber is an acoustic coupling carried out solely by one or more acoustic ducts.

Advantageously, the attenuation device comprises an enclosure configured to house the source and the sound absorber, with the attenuation device being configured in such a way that the first face of the absorber is in acoustic communication with the source by the internal volume of the enclosure.

if n1 and n2 are not arbitrary then n01<n2<n02, n02 can be possibly infinite (no upper limit to the non-linearity).

Advantageously, the coupling element for coupling the second face with the source has an inlet mouth for sound waves coming from the source, with the inlet mouth having a path difference with the first face by a value equal to ½ λc modulo λc, with $\lambda c=(\lambda_2^{0.5}\cdot\lambda_1^{0.5})$ and more generally a value between ½ λc−¼ λc and ½ λc+¼ λc, modulo λc; with $\lambda_1$ being the wavelength of the minimum frequency $f_1$ to be attenuated and $\lambda_2$ being the wavelength of the maximum frequency $f_2$ to be attenuated.

Advantageously, the coupling element for coupling the second face with the source has several resonance frequencies.

According to an embodiment, the first and second faces of the absorber extend in parallel planes.

According to an embodiment, the first and second faces of the absorber are linked mechanically.

According to an embodiment, the coupling element for coupling the second face with the source do not comprises a membrane.

The invention shall now be described in reference to FIGS. 1 to 6.

The diagram 100 illustrated in the figures comprises a source 1 and an attenuation device 10 of the sound emitted by the source 1.

The source 1 emits sound waves of which the frequencies are between the frequencies $f_1$ and $f_2$, of which the instantaneous acoustic pressures are between $p_1$ and $p_2$ of which the pressure levels are between $n_1$ and $n_2$. The term pressure level refers to the average of the instantaneous acoustic pressures in the sense of the least squares (effective value).

Typically, in the framework of the invention, $f_1$ is higher than 20 Hz and is preferably between 20 and 1000 Hz and $f_2$ is less than 20,000 Hz and is preferably between 40 and 1000 Hz.

Advantageously, in the framework of the invention n1 is higher than 100 Pa.

Without this being limiting of the invention, the source 1 can for example be the intake mouth of the air of the supply circuit for an internal combustion engine. In these engines, the mouth allows a noise to escape that is usually qualified as mouth noise. The invention is not limited to attenuating mouth noises.

The attenuation device 10 in particular comprises a sound absorber 11. This absorber 11 comprises at least one membrane 12.

In the embodiments that will be described in what follows in reference to FIGS. 6 and 7 for example, the absorber 11 comprises several membranes 12.

Regardless of the number of membranes 12 that the absorber has 11, the latter has a first face 13 and a second face 14. These two faces 13, 14 are separate and are most often opposite.

The membrane is a flexible membrane. It provokes the absorption of said noises of the source by deforming itself.

According to the invention, the flexible membrane 12 must be able to be deformed in a non-linear manner in order to absorb the acoustic energy. It has indeed been shown in literature (see the article of B. Cochelin, P. Herzog, P. O. Mattei, "Experimental evidence of energy pumping in acoustics" in Comptes Rendus de l'Académie des sciences, Comptes Rendus Mécanique (C. R. Mécanique) volume 334, pages 639 to 644, 2006) that a flexible membrane can be deformed with substantial amplitude in order to be able to pump the acoustic energy of an acoustic mode irreversibly over a wide band of frequencies. This phenomenon of acoustic energy pumping is due to the non-linear behaviour of the membrane (able to be subjected to substantial deformations) that can match the frequency of the acoustic mode to be absorbed, when it has sufficient energy.

As such, the acoustic transfer function of the device is non-linear between p1 and p2, in that it is not proportional to the acoustic pressure, between f1 and f2, during a portion at least of the operating cycle of the device, i.e. during a portion at least of the operating cycle of the source.

The operation of the source and of the device are not necessarily periodical. If they are periodical, the operating cycle then corresponds to their period.

This type of membrane is often qualified as NES, acronym for Non-linear Energy Sink. For this type of membrane, reference can be made to the following publication: A. F. Vakakis, O. V. Gendelman, G. Kerschen, L. A. Bergman, M. D. McFarland and Y. S. Lee, Nonlinear Targeted Energy Transfer in Mechanical and Structural Systems, v.I and v.II, Springer, 2009.) ch. 3 p 93.

The membrane 12 has properties that allow it to be deformed in a non-linear manner in a range of frequencies covering at least 70% of that of the waves emitted by the source 1 and in a range of pressure levels covering at least 70% and preferably 100% of that of the waves emitted by the source 1.

The following properties in particular of the membrane 12 are chosen in such a way as to allow it to be deformed in a non-linear manner: its mass, its elastic modulus, its dissipation and tension properties, its density and its dimensions, in particular its diameter and its thickness.

To choose and arrange the membrane, reference can for example be made to the article by B. Cochelin, P. Herzog, P. O. Mattei, "Experimental evidence of energy pumping in acoustics" in Comptes Rendus de l'Académie des sciences, Comptes Rendus Mécanique (C. R. Mécanique) volume 334, pages 639 to 644, 2006)

For example, the flexible non-prestressed membrane 12 is placed in the device at a location that allows it to pump the maximum energy to the sound wave, or in other terms where it will be the most excited by the sound wave. The membrane 12 will therefore advantageously be placed at a pressure antinode so that it can vibrate at substantial amplitudes. However if it is considered that the acoustic speed is negligible, the acoustic pressure can then be considered as spatially uniform and in this case the location of the membrane 12 is of little importance. The coupling of the rear face 14 of the membrane 12 with the source 1, such as provided for by this invention allows for a major deformation of the membrane 12 and good dissipation of the energy pumped by the membrane 12. This dissipation is much more effective than that obtained with the solutions based on an overturning of the rear face 14 with balancing of the pressures between the front 13 and rear 14 faces but without acoustic coupling of the rear face 14.

In such a way as to correctly choose the characteristics of the membrane or membranes 12, it is necessary to know the acoustic mode or modes to be absorbed. When these modes are identified, the characteristics of the membrane or membranes 12 can then be determined in such a way as to obtain a non-linear deformation behaviour and good energy coupling between the membrane or membranes 12 and the acoustic mode or modes to be absorbed. The desired stiffness for the membrane 12 is mainly determined, which is according to the thickness, the surface and the Young's modulus of the membrane 12. The non-linear stiffness is sized according to the intensity of the component of the source at the highest frequency that is to be attenuated, which allows for attenuation over a wide range of frequencies.

To choose the stiffness $\alpha_3$ of the membrane 12, it is assumed that the transversal displacement w(r,t) of the membrane 12 is approximated by the parabolic shape function $w(r,t)=q(t)\ (1-r/R))^2$ where R is the radius of the membrane 12 (assumed to be of circular shape) and r the radial coordinate. It is also assumed that the membrane 12 is deformed with substantial amplitudes (which it the purpose sought). This results in being able to analytically express the stiffness $\alpha_3$ of the membrane 12 according to its Young's modulus E, its thickness and its radius R.

The stiffness $\alpha_3$ can then be expressed using the following equation:

$$\alpha_3=(32/3(1-\nu^2)\pi)\cdot(E/\rho_{air}\cdot C)\cdot(h^3/R^4)\cdot(1/\omega)\cdot(S_t/S_m)$$

wherein v designates Poisson's ratio, E the Young's modulus of the membrane 12, ρ air the density of the air, C the speed of the sound, h the thickness of the membrane 12, R the radius of the membrane 12 (which is assumed to be circular), Ω the frequency of the system of acoustic stationary waves to be absorbed, St the section of the outlet of the clean air in the air filter and Sm the section of the membrane 12.

The effect on non-liner energy pumping is not obtained by a prestressing of the membrane 12 which can, according to the invention, be deformed in substantial amplitudes. The effect of non-linear energy pumping is obtained in particular by the configuration of the coupling of the two faces of the membrane 12 and by the capacity of the membrane to be deformed in a non-linear manner.

The membrane 12 of the absorber can be passive. It can also be motorised or active. It is typically the case when it is provided on a loudspeaker.

The first face 13 of the absorber is acoustically coupled to the source 1, more preferably in a purely acoustic manner. This acoustic coupling makes it possible to transmit the sound to be attenuated between the source 1 and the first face 13.

The acoustic coupling between the source 1 and the first face 13 of the absorber 11 can be carried out via at least one acoustic connection 15'.

The term acoustic connection designates a connection that allows for a correlation in the two opposite directions of propagation of the sound wave.

The term coupler designates a means for transmitting acoustic power between several locations, either via an acoustic connection, or via any other conversion, for example via an electro-acoustic conversion. A coupler is characterised by the existence of a correlation, whether or not linear, of the pressure at the point identified as being the outlet of the coupler in relation to the pressure of the point identified as being the inlet of the coupler. In the case of a connection of the acoustic type, a correlation also exists in the other direction.

As such, by placing a microphone at the inlet and at the outlet of an element, it can be verified whether or not it is a coupler.

Preferably, an acoustic coupler whether it is purely acoustic or electroacoustic between a source emitting waves with a pressure level between n1 and n2 in a frequency range f1-f2 and a face of a membrane makes it possible to transmit at least 20% and more preferably at least 70% and more preferably as close as possible to 100% of the pressure level or of the amplitude of the source to the membrane for a range of frequencies covering at least 70% of the range f1-f2.

Preferably, the acoustic or electroacoustic coupler makes it possible to transmit to the membrane 100% of the sound level of the source for a range of frequencies covering 100% of the range f1-f2.

An acoustic coupler as such makes it possible to establish an acoustic path between two separate locations, as such allowing for the transmission of the sound, with a possible transformation.

Preferably, the acoustic or electroacoustic couplers used in the framework of this invention have a maximum of transmission for a frequency higher than the lowest of the frequencies to be attenuated in the primary system. Preferably, each coupler has a maximum of transmission for a frequency between the emission frequencies f1 and f2 of the source.

Preferably, the acoustic couplers of this invention can be qualified as wide band.

A wide band coupling allows for the acoustic transmission in a wide range of frequencies, in contrast with a Helmholtz resonator that transmits sound waves in a narrow range around a single resonance frequency. For example, conical bore tubes (cones) are known to be wide band acoustic transmitters.

The couplers of this invention can also have several resonance frequencies included in the range of frequencies $f_1$, $f_2$ of the source 1.

The acoustic coupling between the source 1 and the first face 13 of the absorber 11 can be carried out by at least one acoustic coupling 15 made from an acoustic duct 15.

Figure 4A:
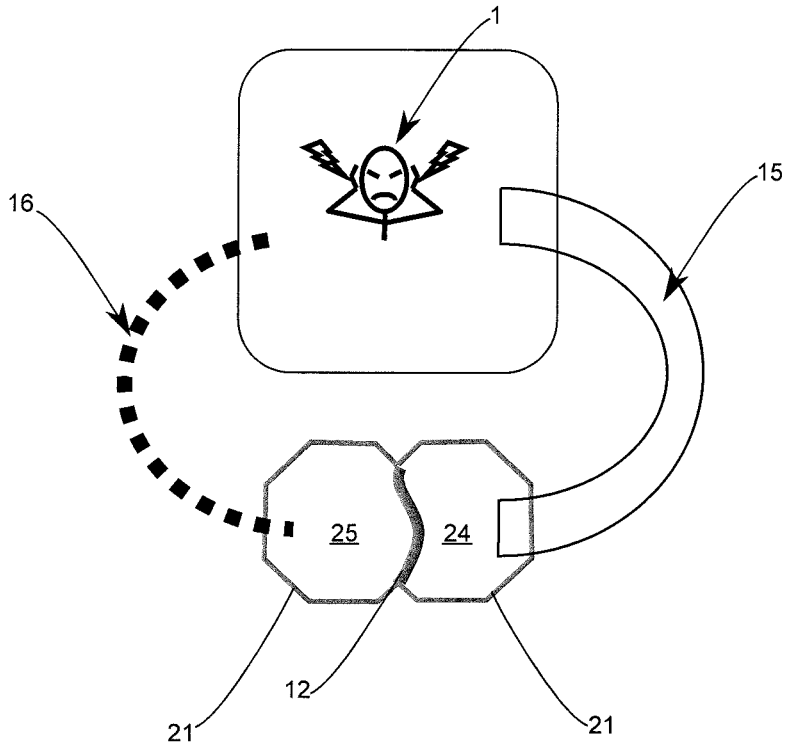
FIG. 4*a* is a diagram of another example of an embodiment of the invention comprising an acoustic coupling chamber facing the second face of the membrane and coupled acoustically to the source.
Figure 4B:
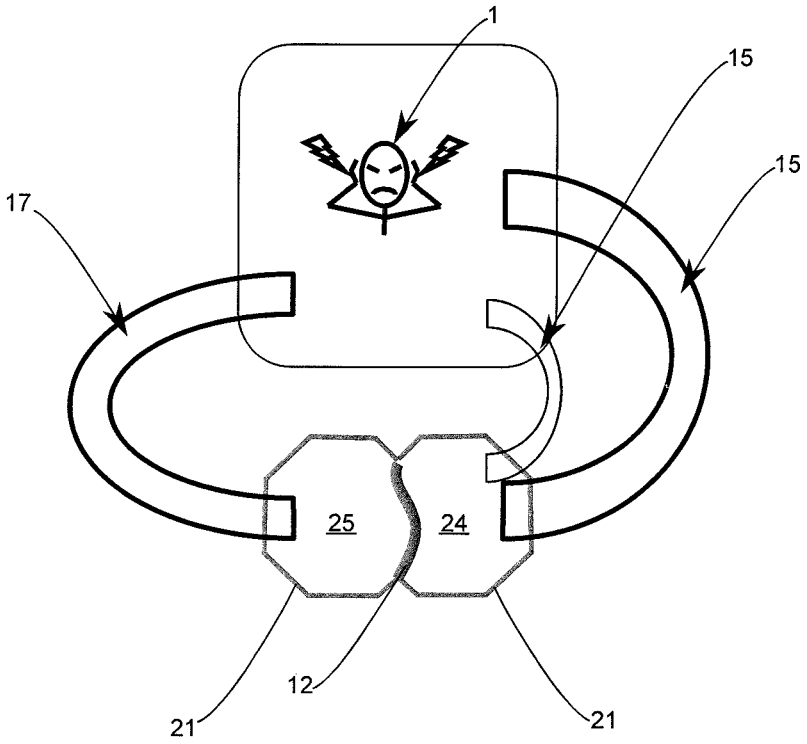
FIG. 4*b* is a diagram of another example of an embodiment of the invention wherein several couplers acoustically couple the first face of the membrane to the source.

In certain embodiments, such as the one shown in FIG. 4*b*, this acoustic coupling is carried out by two couplers 15, 15 each one formed from an acoustic duct.

Figure 5A:
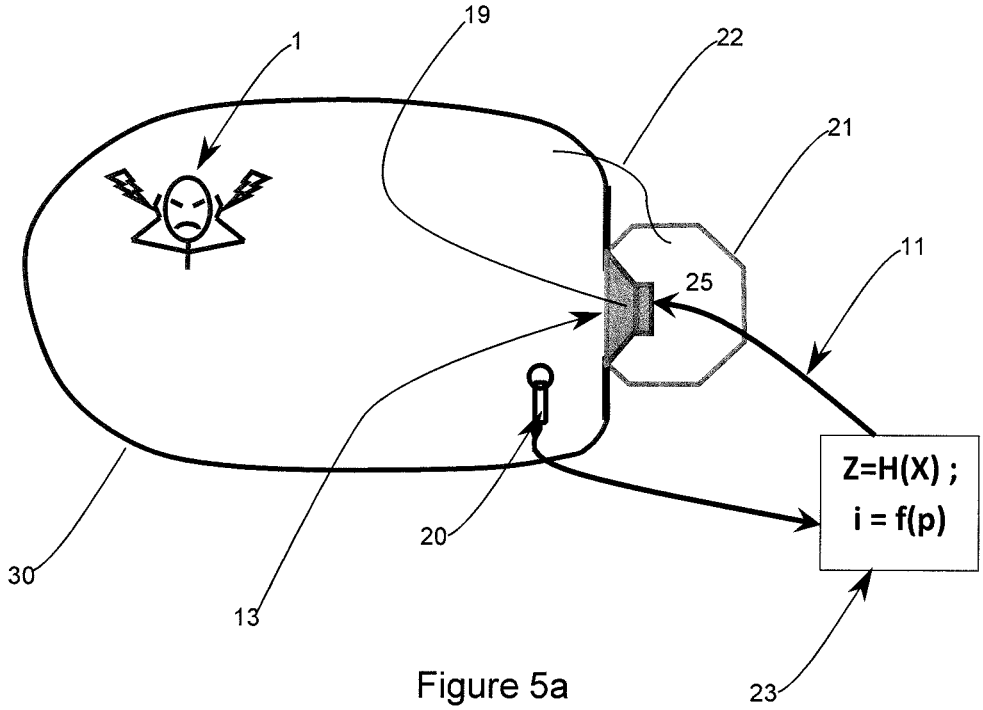
FIGS. 5*a* and 5*c* are diagrams of other example embodiments of the invention wherein the coupling between the second face of the membrane and the source is an electro-acoustic coupling.
Figure 5B:
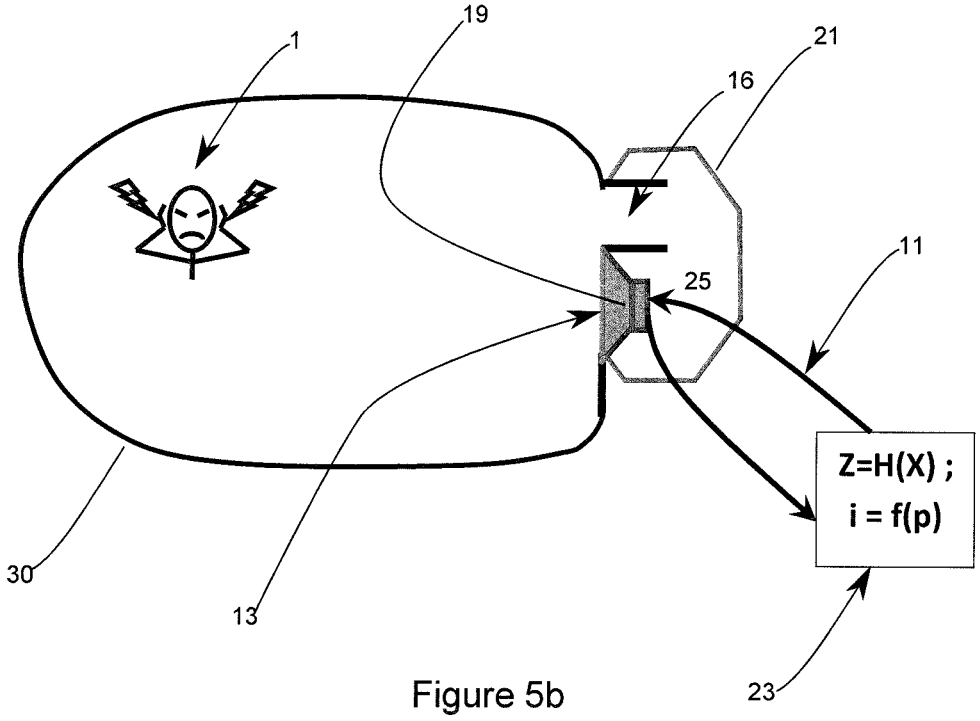

According to another embodiment, the acoustic coupling is carried out by placing the first face 13 facing the source 1, such as is shown in FIG. 5*a*, 5*b*. This is then referred to as direct acoustic communication.

Particularly advantageously, the device 10 is configured in such a way that the second face 14 of the absorber 11 is also coupled to the source 1. This coupling can be a solely acoustic coupling, as shown in the non-limiting examples of FIGS. 1 to 4. It can also be an electro-acoustic coupling as shown in the non-limiting examples of FIGS. 5*a* to 5*c*.

Typically, the coupling between the source 1 and the second face 14 makes it possible to transmit at least 20% of the instantaneous acoustic pressure during a portion of the cycle in a range of frequencies at least equal to 70% and preferably equal to 100% of the range $f_1$, $f_2$ of the source 1.

The definition of the acoustic coupling and of the couplers given hereinabove for the first face 13 also applies to the second face 14.

More precisely, the coupling element 16 from second face 14 to the source 1 is configured to transmit a maximum sound level for sound waves of which the frequencies are higher than $f_1$.

As such, the two faces 13, 14 of the absorber 11 are acoustically coupled to the source 1. Preferably, this difference in pressure is such that the instantaneous acoustic pressures P1 and P2 are exerted at a given instant on the first and second faces 13, 14 respectively and during at least one portion of the operating cycle of the source 1 satisfy the following condition: $|P_1-P_2|>k.|P_1|$, with k>0.2 and more preferably k>0.5 and more preferably k>1, and more preferably k>1.5, and more preferably k>1.8.

As such, the first and second faces 13, 14 are used in a non-linear manner, and participate in the sound absorption.

The device is configured in such a way as to impose upon the waves coming from the source 1 a path difference between those that arrive on the first face 13 and those that arrive on the second face 14 at the same time.

This path difference results in a difference in the phase and/or the amplitude between the sound waves arriving on the two faces 13, 14 at the same time.

For example, the acoustic couplings of the two faces 13, 14 with the source 1 can be chosen in such a way that the sound waves of the source 1 arrive on the second face 14 with an amplitude identical to those arriving at the same time on the first face 13 but with an opposite phase.

More generally, the coupling element for coupling the second face with the source is configured in such a way that the sound waves coming from the source and reaching the second face 14 have a path difference in relation to those reaching the first face 13. This path difference can be characterised in the following way: the coupling element for coupling the second face with the source has an inlet mouth of the sound waves coming from the source, with the inlet mouth having a path difference with the first face of a value equal to ½ λc modulo λc, with $\lambda c=(\lambda_2^{0.5}\cdot\lambda_1^{0.5})$ and more generally a value between ½ λc−¼ λc and ½ λc+¼ λc, modulo λc; $\lambda_1$ being the wavelength of the frequency $f_1$ to be attenuated and $\lambda_2$ being the wavelength of the maximum frequency $f_2$ to be attenuated. The two faces 13, 14 are then used and participate in attenuating sounds.

The device is then configured in such a way that this acoustic coupling on the two faces 13, 14 creates a difference in pressure during at least one portion of the operating cycle of the source 1.

The device can comprise a cover 21, facing the second face 14 in order to prevent the emission of secondary radiation. The cover 21 will not disturb the deformation of the second face 14, with the latter being set into movement by the sound waves received from the source 1 to which it is coupled.

In order to create a path difference between the waves arriving at the same time on the first and second faces 13, 14 of the absorber 11, the device, according to certain embodiments, preferably provides in combination with the coupling elements, a distance "d" between the second face 14 and the inlet of the coupling element 16 coupling this face 14 to the source 1. "d" is chosen in such a way as to provide all or at least participate in the creation of the path difference.

Preferably, d≤½ $\lambda_2$ modulo $\lambda_2$, (i.e. d≤n.½ $\lambda_2$, with n any relative integer), $\lambda_2$ being the wavelength of the maximum frequency to be attenuated and more preferably d≤¼ $\lambda_2$.

Advantageously, the at least one coupling element 16 of the second face 14 with the source 1 is configured to transmit to the second face 14 sound waves of which the phase and/or the amplitude results in that IP1−P2I>k·IP1I during at least X % of the operating cycle of the source 1, with X=10. According to an embodiment, X=30.

According to an embodiment, the sound absorber 11 has a linear resonance frequency $f_{rl}$, with $f_{rl}$<f1. As such the sound absorber, typically a membrane, has a linear resonance frequency strictly lower than the minimum frequency to be attenuated. If the sound absorber comprises several membranes, then each membrane has a linear resonance frequency strictly lower than the minimum frequency to be attenuated.

The membrane or membranes of the acoustic absorber, by having a linear resonance frequency $f_{rl}$, with $f_{rl}$<f1 and by having a behaviour in non-linear deformation when it receives sound waves of which the frequencies are between $f_01$ and $f_02$, with the range $f_01$-$f_02$ covering at least 50% of the range f1-f2, makes it possible to generate the phenomenon of energy pumping, which results in a particularly effective attenuation of the noise of the source.

Advantageously the at least one coupling element 16 of the second face 14 with the source 1 is configured in such a way that a given instant the acoustic system comprising the membrane reaches a state able to trigger the acoustic pumping, which is reached for example, in a non-limiting way, by adding noise at different frequencies of the range of frequencies of interest during a limited time see Côte et al. JSV 333 2014 5057-5076.

When the range of frequencies transmitted by the coupling element is for a portion higher than the frequency f2, the signal transmitted by the coupling element contributes to the triggering of the absorption regime sought, and the noise generated or transmitted at high frequencies can easily be attenuated by conventional systems such as porous sorbents. The action of the coupler can be verified by measuring an increase in the sound level when the coupling is interrupted, for example by the inserting of a rigid wall, or by detecting a change in the non-linear mode characterised by its stationarity, its spectrum, and where applicable the amplitudes and phases of its components. The design of the coupler can be verified by measuring its transfer function. The latter must show a maximum of transmission for frequencies higher than f1.

It stems as such from the above that the invention improves the acoustic comfort and reduces the damage caused by vibrations, thanks to the transformation of the sound by means of at least one flexible membrane 12 and used on both of its faces 13, 14. The membrane 12 is subjected to substantial deformations under the action of the sound. The non-linearity of the system possibly allows for the appearance of non-linear modes with low amplitude for the primary system and the energy pumping effect.

The invention is in particular based on a membrane 12 that has mass properties, of an elastic modulus, dissipation, and tension, chosen for the desired operating regime (range of frequencies and intensity of the sound). According to an embodiment, the membrane 12 is covered on each one of its two faces 13, 14 with a sealed cover 21 forming chambers, with at least one of the chambers being connected to the primary system either directly, or via an acoustic pipe. The choice of the dimensions of the covers 21 (shape, volume of air contained in the chamber), of the parameters of the pipes (shape, length, diameter, positions of the connection to the primary system), make it possible to adapt the system to the target application. The invention can also make use of the existing volumes in the system of the primary source in order to carry out the chambers and pipes.

With respect to patent EP 2172640 A1 mentioned in the section on prior art, the dissipation chamber is replaced with a rear coupling chamber 16 connected either to the primary system, or to an acoustic load. The coupling can be acoustic, electro-acoustic or by any other means. The main chamber can be part of the primary system or be connected to it acoustically.

Details on the specificities of the embodiments shown in FIGS. 1 to 7 shall now be provided.

FIG. 1 shows an embodiment wherein the source 1 is coupled to the absorber 11 by a uni-directional 15 or bi-directional 15' coupler. This coupler allows for an acoustic coupling between the source 1 and the first face 13 of the absorber 11.

A uni-directional coupler is characterised by the fact that it transmits information in a single direction.

A bi-directional coupler is characterised by the fact that it transmits information in two opposite directions of the same path (straight or not), for example in the two opposite directions of the same straight direction.

The coupling element 16 allows for an acoustic coupling between the source 1 and the second face 14 of the absorber 11.

As shown, allows for an acoustic coupling between the source 1 and the first face 13 of the absorber 11 can be a solely acoustic absorber, having as in this example two membranes 12, 12'.

The face of the membrane 12 that is connected to the source 1 by the coupler 15 acts as a first membrane 14 for the absorber 11. The face of the membrane 12' that is connected to the source 1 by the coupler 16 acts as a second membrane 13 for the absorber 11.

As also shown in this figure in order to represent an alternative embodiment, the sound absorber can be or comprise a loudspeaker 19.

Figure 2:
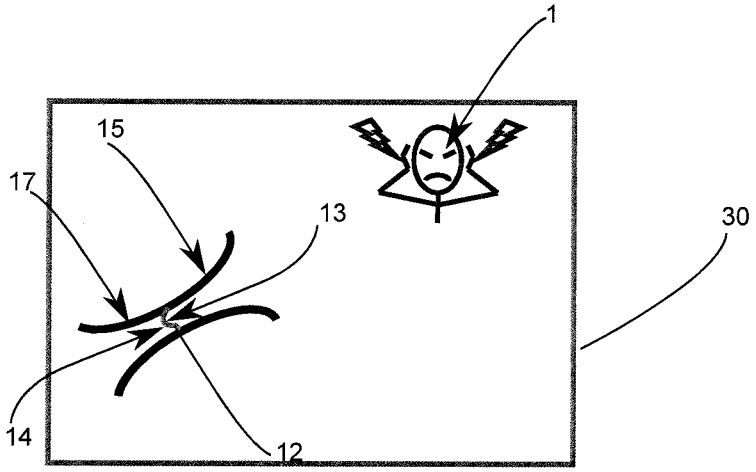
FIG. 2 is a diagram of another example of an embodiment of the invention, wherein the absorber is duct that is flared at its ends.

FIG. 2 shows an embodiment wherein the source 1 is housed in an enclosure 30 inside of which is arranged the absorber 11 of the device 10. The absorber 11, in the form of a membrane 12 or of a stack of membranes is arranged in a tube. The tube is preferably flared at each one of its ends in order to form a cone.

A first section of the tube arranged between a first end of the tube and a first face 13 of the absorber 11 forms an acoustic coupling between this face 13 and the source 1. A second section of the tube arranged between a second end of the tube and a second face 14 of the absorber 11 forms an acoustic coupling between this face 14 and the source 1.

In this embodiment as in that of FIG. 3 and the following, the first 13 and second 14 faces of the membrane 12 extend in parallel planes. In this embodiment as in that of FIGS. 3 to 6 and 7*b* and the following, the first 13 and second 14 faces of the membrane 12 are linked mechanically.

The form and the dimensions of the tube, for example its diameter, its flaring and its arrangement in relation to the source 1 are chosen in such a way as to create the pressure differential on each face of the absorber 11, as such allowing the membrane 12 to be deformed freely and to use its two faces.

The enclosure 30 makes it possible to confine the device 10 and the source 1 for a better attenuation of the sounds.

Figure 3A:
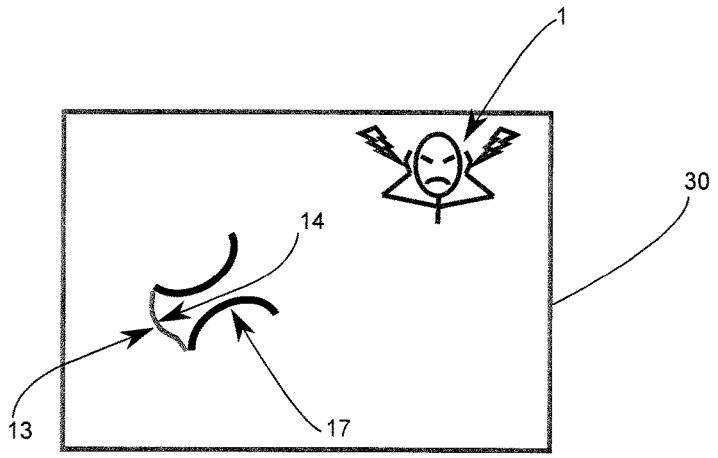
FIGS. 3*a* and 3*b* are diagrams of other embodiments of the invention.

FIG. 3*a* shows an embodiment that differs from that of FIG. 2 in that the absorber 11, for example in the form of a membrane 12 or of a stack of membranes mounted in series or in parallel, is arranged at an end of a tube. The face turned towards the exterior of the tube acts as a first face 13 for the absorber 11. The coupling between this face and the source 1 is therefore direct and is done through the intermediary of the internal volume of the enclosure 30. The one turned facing the inside of the tube acts as a second face 14 for the absorber 11. The coupling of this face 14 and the source 1 is therefore done via the tube 17 forming the coupling element 16.

According to an embodiment, the coupling element 16, here the tube 17 comprises at least one acoustically absorbent element preferably arranged on an internal wall of the coupling element 16. Advantageously, the acoustically absorbent elements are configured to absorb at least partially the high frequencies produced by the source 1 and/or by the attenuation device, for example the 30% or 10% of the highest frequencies produced by the source and/or by the attenuation device.

According to an embodiment, the at least one acoustically absorbent element is glass wool.

This optional embodiment and optional with absorbent element positioned in the acoustic coupling element is applicable to all of the other embodiments described in this invention.

Figure 3B:
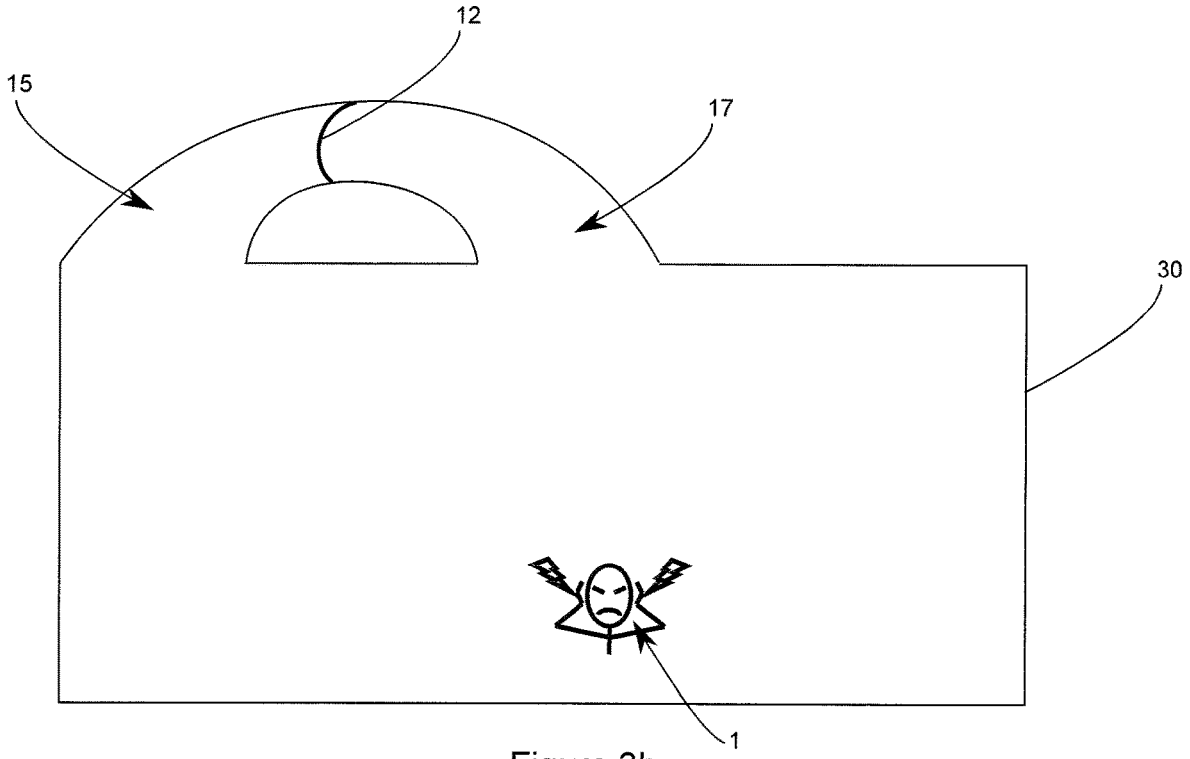

FIG. 3*b* shows an embodiment wherein the source 1 is located or opens into the enclosure 30. This enclosure 30 comprises, outside of its volume, a duct inside of which is arranged the absorber 11 typically a membrane 12 or a plurality of membrane mounted in series or in parallel. A first section of the duct 15 forms the coupling between a first face 13 of the membrane 12 and the source 1 and a second section of the duct 17 forms the coupling between a second face 14 of the membrane 12 and the source 1.

This embodiment differs therefore from that of FIG. 2 in particular in that the coupling elements 15, 17 of the source 1 to the faces 13 and 14 of the absorber 11 are arranged outside of the enclosure 30.

Figure 4C:
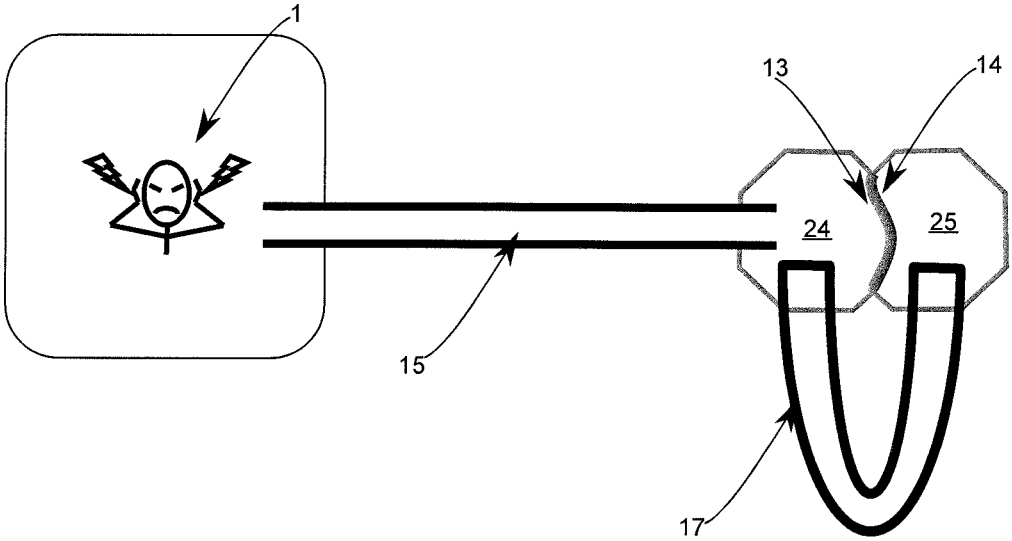
FIG. 4*c* is a diagram of another example of an embodiment of the invention wherein the coupling element is formed of several elements of which a coupling with the front chamber and a coupling between the front chamber and the source.

FIGS. 4*a*, 4*b* and 4*c* show embodiments wherein the absorber 11 comprises a cover 21 arranged facing the first face 13 of the membrane 12.

This cover 21 forms a front coupling chamber 24. It is indeed coupled to the source 1. This coupling is preferably a purely acoustic coupling. It can for example be comprised of a plurality of ducts or pipes, for example two as shown in FIG. 4*b*.

The second face 14 of the membrane 12 is also coupled to the source 1 by the coupling element 16. The coupling can be solely acoustic (one duct for example) or be electro-acoustic. The dotted lines used in FIG. 4*a* show the fact that different types of coupling elements 16 can be used.

Preferably, the device 1 comprises a cover 21 facing the second face 14, defining with the latter a rear coupling chamber 25. The area chamber 25 is not closed but allows for an acoustic connection between the coupling element 16 and the source 1.

As such, the second face 14 is placed in a coupling chamber 25 not in a dissipation chamber as was provided for in solutions of prior art mentioned in the section concerning prior art.

In the embodiment shown in FIG. 4*c*, the rear coupling chamber 25 is coupled to the source 1 via the front chamber 24. A duct 17 acoustically couples the front 24 and rear 25 chambers, with the front chamber 24 being coupled to the source 1 by the coupler 15. This embodiment clearly shows that the coupling element 16 of the second face 14 to the source can include several elements, here: a duct 17, the front chamber 24 and the conduit 15.

In these embodiments, the properties of the member or members 12, of the covers 21 and of the couplers 15 and 17, are chosen with respect to the source 1 in such a way as to create the pressure differential on either side of the faces 13, 14, which as such allows at least one membrane 12 to be deformed in a non-linear manner and to create for each one of its faces an energy pumping.

Figure 5C:
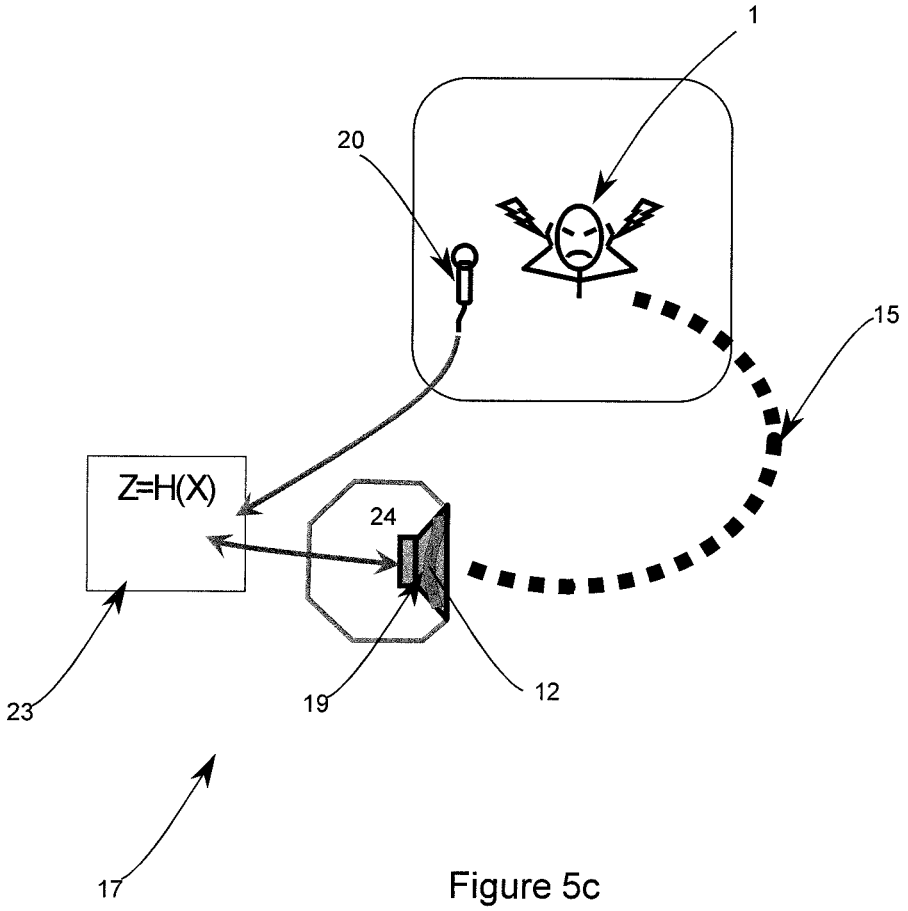

FIGS. 5*a*, 5*b*, 5*c* show embodiments wherein the absorber 11 is an electro-acoustic absorber. It comprises a loudspeaker 19. The membrane or membranes 12 are then motorised membranes.

In the embodiments of FIGS. 5*a* and 5*b*, the primary source is placed in an enclosure 30 and a front face of the loudspeaker 19 is also arranged in or facing this enclosure 30. It can, as shown, form a portion of the wall of the enclosure 30. As such, the acoustic coupling between the first face 13 of the absorber 11 and the source 1 is a direct coupling.

The second face 14 of the absorber 11 or rear face is placed in a cover 21.

The device 10 is provided with a module for controlling 23 the loudspeaker 19. This module for controlling controls the membrane 12. This controlling is carried out in such a way as to carry out on the membrane, during a portion of the operating cycle, a linear or not function of the pressure relative to the source 1 including by measurement of magnitudes linked to the movement of the membrane. As such, this controlling takes into account in particular information relative to the source 1.

In the embodiment of FIG. 5*a*, this information relative to the source 1 is captured by a microphone 20. It is more preferably placed inside the enclosure 30 and is therefore a direct acoustic coupling with the source 1. Preferably, the cover 21 is then closed except for a static pressure balancing capillary. This capillary 22 has a strong inertia, for example a high length to diameter ratio, in such a way as to balance the average pressure between the enclosure 30 and the chamber 25.

This capillary 22 however does not make it possible, because of its inertia, to transmit the rapid vibrations and therefore the sound waves of the source 1.

In the embodiment of FIG. 5*b*, this information relative to the source 1 is captured on the surface of the second face 14 of the membrane of the loudspeaker 19.

The device 10 by taking the information on the surface of the membrane 12 as such measures the dual magnitude of the loudspeaker 19. For example if the loudspeaker 19 is controlled in voltage, the current is measured, and vice-versa. This makes it possible to measure the response of the loudspeaker 19 to all of the stresses to which it is subjected.

In these embodiments also, the coupling between the second face 14 or the rear of the loudspeaker 19 and the source 1 is therefore indeed an electro-acoustic coupling.

Moreover, in this embodiment, the device 10 has a coupling element 16 that is purely acoustic between the rear face of the loudspeaker 19 and the source 1. This acoustic coupling comprises for example a channel between the enclosure 30 and a cover 21 wherein the second face 14 of the absorber 11 is placed. The properties of this channel, in particular its volume, its diameter, its length and its position and its shape allow it to transmit the sound waves of the source 1 to the inside of the chamber 25. This coupling element therefore does not allow only a balancing of the pressure contrary to the capillary 22 of the preceding embodiment.

As such, in this embodiment, the chamber 25 is an acoustic coupling chamber.

FIG. 5*c* shows an embodiment close to that of FIG. 5*a* and which differs from it by the way in which the first face 13 of the loudspeaker 19 is coupled to the source 1. This figure shows as a dotted line a coupling that may not be a direct acoustic coupling as provided for in the embodiment of FIG. 6, but can possibly be an acoustic coupling carried out by a duct 15 or by an electro-acoustic coupler.

Figure 6:
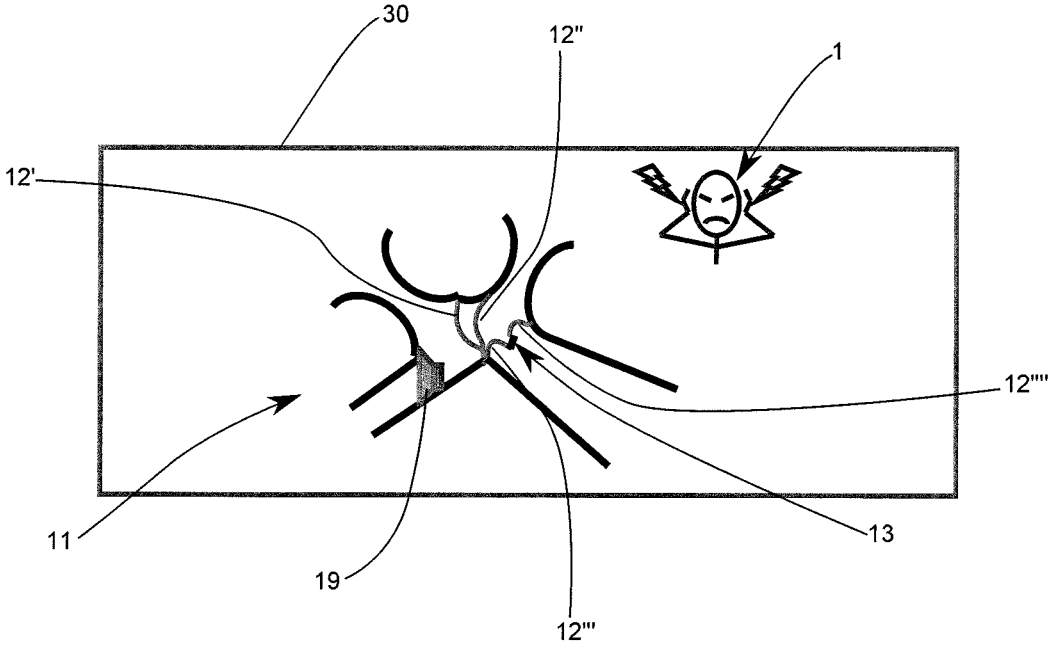
FIG. 6 is a diagram of another example embodiment of the invention wherein the sound absorber comprises a plurality of membranes.

FIG. 6 shows an embodiment wherein the absorber 11 comprises a plurality of membranes 12. In this non-limiting example, it comprises four membranes 12 and a motorised membrane provided on a loudspeaker 19.

The two membranes 12' and 12" together form an absorber comprising two faces facing one another and two faces 13, 14 turned towards the outside and acting as first and second faces coupled to the source 1.

The two membranes 12''' and 12'''' each having a face which together define a first face 13 and each having a face that together define a second face 14.

The device comprises as many couplers as necessary in order to couple each one of the front and rear faces to the source 1.

Figure 7A:
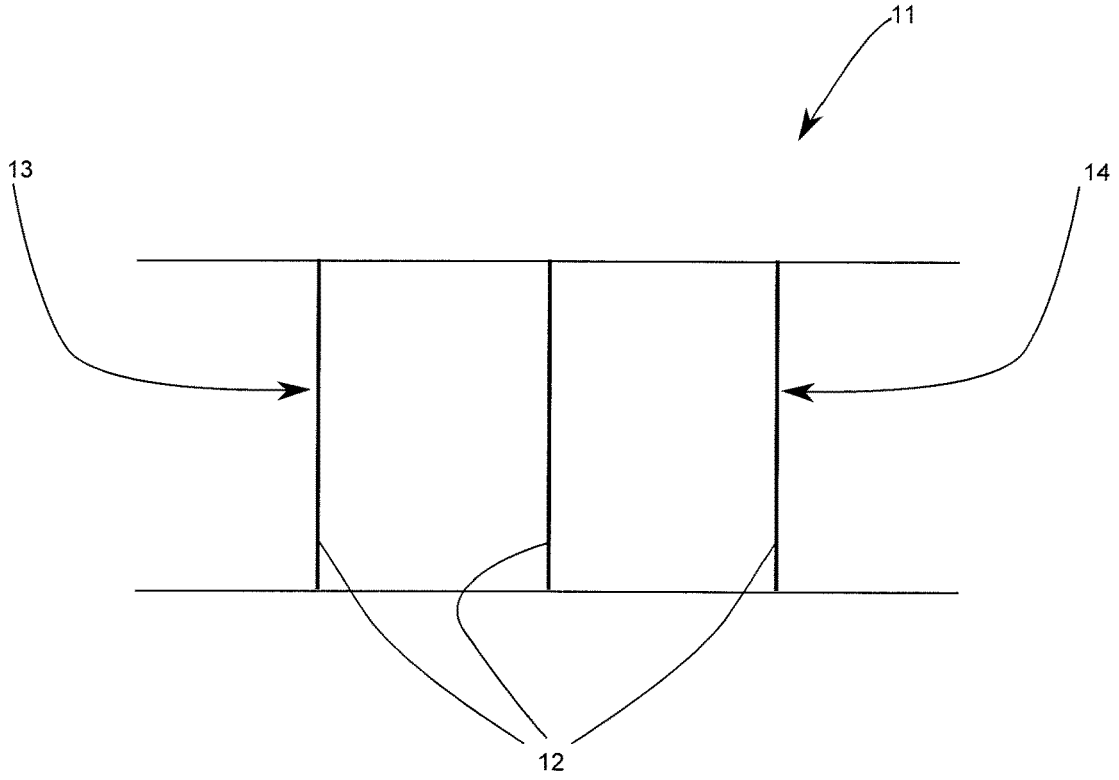
FIGS. 7*a* and 7*b* show two embodiments of an absorber that can be used for all of the embodiments of the invention.
Figure 7B:
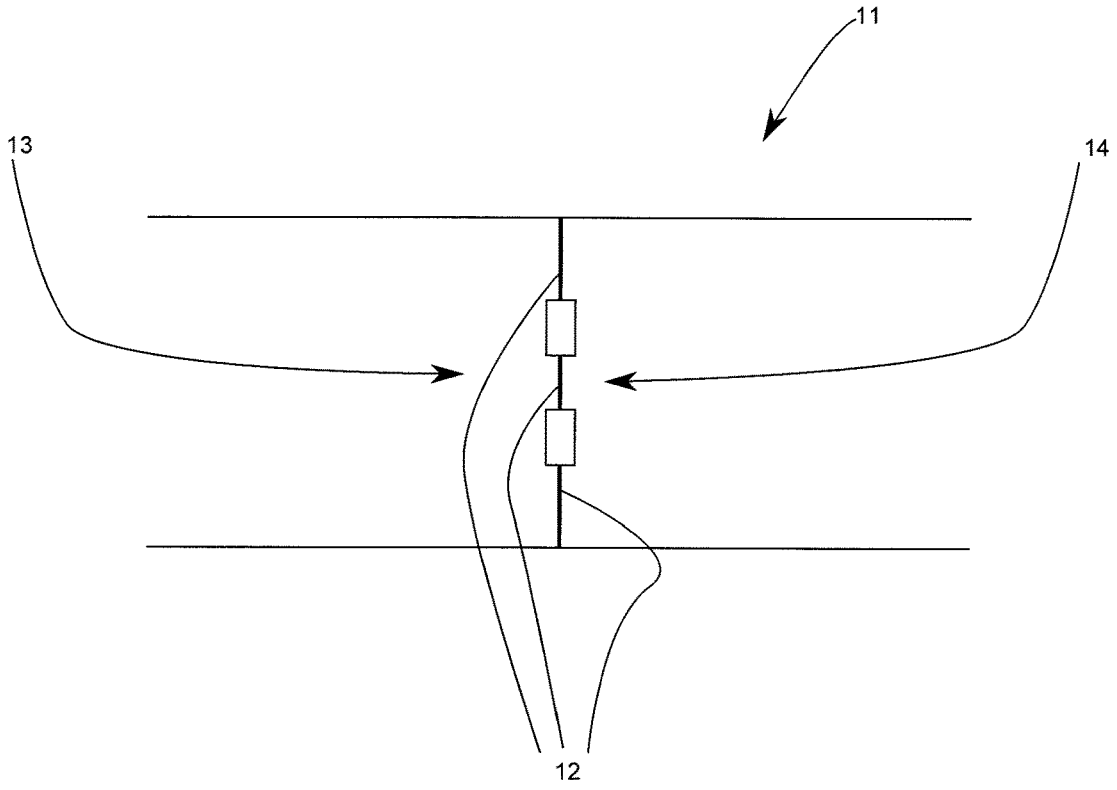

FIGS. 7*a* and 7*b* show two embodiments of an absorber 11 that can be used for all of the embodiments of the invention. In each one of these two embodiments, the absorber 11 comprises a plurality of membranes 12. Preferably, each one of these membranes has properties that allow it to be deformed in a non-linear manner for a portion at least of the frequency range $f_1$-$f_2$ and range of pressure levels $n_1$-$n_2$ of the source 1.

In the embodiment shown in FIG. 7*a*, the absorber 11 comprises a plurality of membranes 12 arranged in series. The face turned towards the outside of an external membrane forms the first face 13 coupled to the source 1 and the face turned towards the outside of another external membrane forms the second face 14 coupled to the source 1.

In the embodiment of FIG. 7*b*, the membranes are associated with one another in such a way that one of their faces together form the first face 13 of the absorber 11 coupled to the source 1 and in such a way that the other of their faces together form the second face 14 of the absorber 11 coupled to the source 1.

DETAILED EXAMPLE OF AN EMBODIMENT

A non-limiting example shall now be detailed in reference to FIGS. 8*a*, 8*b*, 9*a* and 9*b*.

Figure 8A:
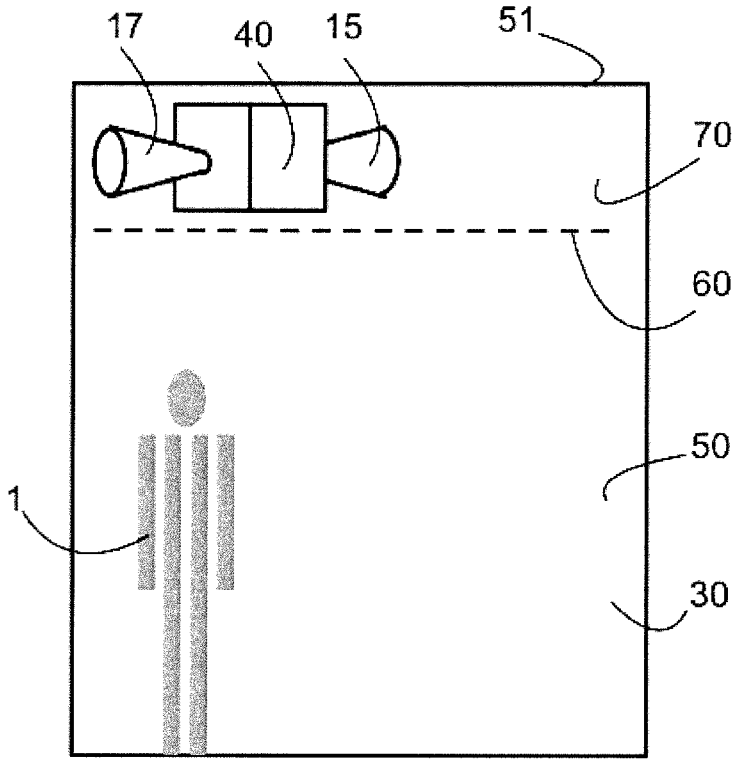
FIGS. 8*a* and 8*b* show an embodiment of the invention, wherein the attenuation device is arranged in a false ceiling of a room.
Figure 8B:
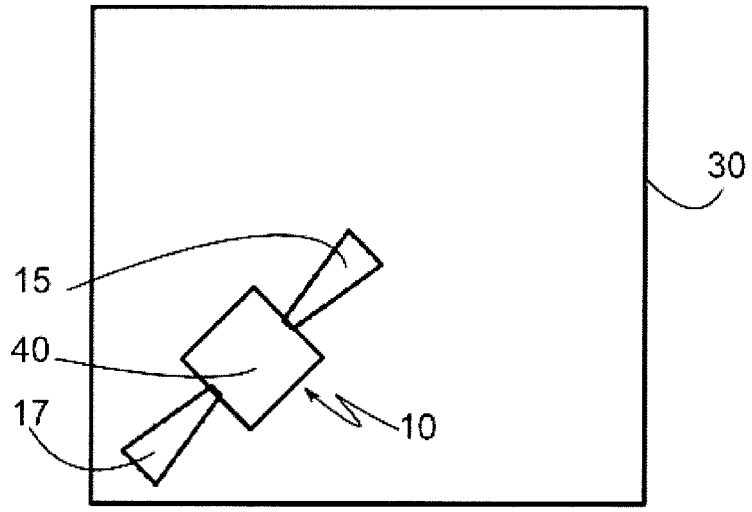
Figure 9A:
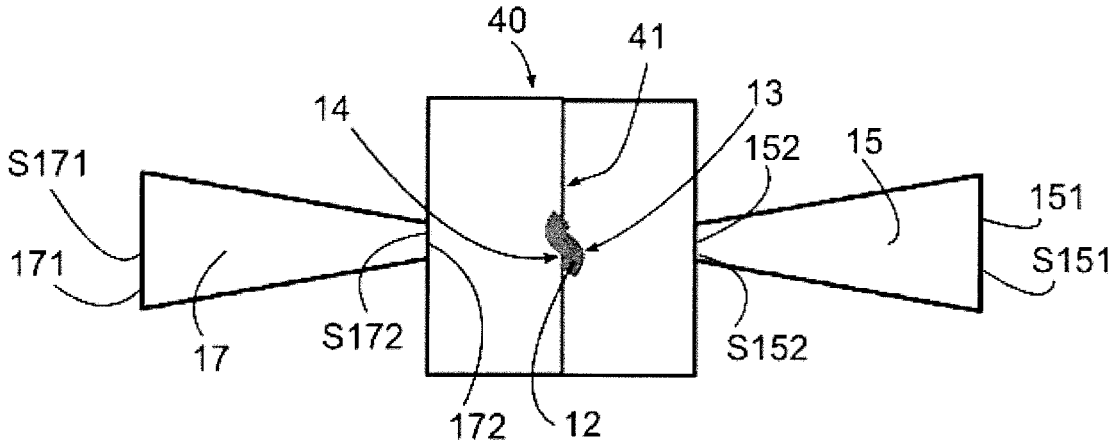
FIGS. 9*a* and 9*b* are simplified views, respectively as a front cross-section and on the side, of the attenuation device used in the embodiment shown in FIGS. 8*a* and 8*b*.
Figure 9B:
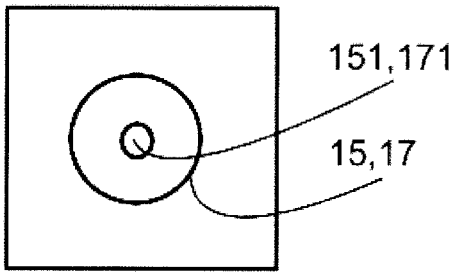

This example describes a device 10 for attenuating sound, also designated as squelcher, intended to be arranged in an intermediate space formed between a false ceiling 60 and the upper wall 51 of a room 50. This arrangement is shown in FIG. 8*a*. In this arrangement, the source 1 emitting sound waves is any person or equipment of the room 50. The entire room as such forms an enclosure 30 in terms of this invention.

The false ceiling 60 is configured in such a way as to allow sound waves to pass from the source 1 to the attenuation device 10.

The attenuation device 10 comprises a caisson 40 or box enclosing a membrane 12. The caisson is closed except for two openings from which extend respectively an acoustic coupler 15, 17. Each one of the acoustic couplers 15, 17 forms a pavilion. In this embodiment, the acoustic couplers 15, 17 are identical.

Each acoustic coupler 15, 17 forms a truncated cone. In this example, the end 152, 172 with the smaller diameter has a diameter 4 times less than that of the end 151, 171 of larger diameter. Each end 152, 172 of smaller diameter is fastened to the caisson 40 and more precisely on an opening of the latter. Each acoustic coupler 15, 17 as such closes off an opening of the caisson 40.

The acoustic couplers 15, 17 are aligned along the axis of the truncated cone.

Preferably, the attenuation device 10 is oriented according to a diagonal of the room 50. As such the axes of the truncated cones are parallel to the plane containing the false ceiling 60 and are oriented according to a diagonal of the latter.

The membrane 12 is borne by a sealed partition 41. As such, the caisson 40 combined with the partition 41 defines two chambers with each one forming a coupling volume.

The membrane 12 used has in this example a diameter of 6 cm. It is in accordance with that described in the publication C. R. Mécanique 334 (2006) already mentioned hereinabove: B. Cochelin, P. Herzog, P. O. Mattei, "Experimental evidence of energy pumping in acoustics" C. R. Mécanique volume 334, pages 639 to 644, 2006.

The overall length of the device 10 formed by the caisson 40 and the acoustic couplers 15 is about 1.7 m. The device is intended for attenuating sounds of which the frequency is around 100 Hz.

The operation of the device 10 is conditioned by the characteristics of the membrane 12 and by the dimensions of the coupling volumes that surround it.

With respect to a solution wherein only one of the faces of the membrane is used and wherein there would therefore be only one acoustic coupler (a single pavilion coupled to the membrane), the attenuation device 10 according to the invention has the following specificities and advantages:

The encasing of the membrane makes it possible to absorb the high frequency noise by passing through the pavilion, without this noise being directly radiated in the room 50.

The encasing of the membrane does not degrade the performance as the second pavilion (in addition to the first pavilion) provides an acoustic coupling.

The invention also allows for the simultaneous processing of several resonant modes of the part 50 where the device 10 is implanted. Obviously if their frequency is identical and their path difference corresponds to ½ wavelength, difference measured on the membrane. Different frequency modes which may be immeasurable can also be attenuated (cf. JSV332(2013)1639, S. Bellizzi and coauthors, "Responses of a two degree-of-freedom system coupled to a nonlinear damper under multi-forcing frequencies" in Journal of Sound and Vibration, volume 332, pages 1639 to 1653, 2013).

A few additional details of this embodiment are provided hereinbelow:

- Room 50: The floor of the room 50 forms a square with a diagonal of 3.6 metres. It has a height under the false ceiling 60 of 3 m.
- The length of the coupler 15, 17 is taken along the main axis: 45 cm;
- Surface S151, S171 of the end with the larger diameter: 0.11 square metres;
- Surface S152, S172 of the end with the smaller diameter: 0.0069 square metres;
- Caisson 40 forming a cube with a side of 48 cm;
- Sealed partition 41 defining with the caisson 40 two volumes of 0.056 cubic metres each.

In the preceding description, it clearly appears that the invention improves the acoustic comfort and reduces the damage due to the vibrations, thanks to the transformation of the sound by means of an absorber such as a flexible membrane. Moreover, the membrane that is used on its two faces does not have any direct radiation in the premises (which procures better comfort), and the implantation of couplers in two separate points makes it possible to process more acoustic modes. The connection of the rear face of the membrane to the primary acoustic source creates an acoustic load at the rear face of the membrane. This acoustic load pumps the air of the rear chamber and deforms the membrane in a manner coordinated with the primary source. The non-linearity of the system allows for the appearance of non-linear modes of low amplitude for the primary system and the membrane is subjected to substantial deformations under the action of the sound. The invention as such makes it possible to prevent the problem of secondary radiation without hindering the attenuation of the sound.

It also results from the preceding description, that the invention procures the following technical advantages due to the coupling of the second face of the membrane with the source and the non-linearity of the operation of the membrane:

- suppression of the radiation towards the outside without cancelling the effectiveness of the transformation of the sound;
- use of the apparent linear stiffness added to the membrane by the coupling chamber to improve the effectiveness of the transformation of the sound;
- coordination of the effects on either side of the membrane so that they act in cooperation in order to improve the effectiveness of the transformation of the sound;
- possible coupling of the membrane in several positions of the source in order to improve the effectiveness of the transformation of the sound.
- overturning of the membrane making it possible to offset the invention far from the primary system. This is useful in particular for reasons of encumbrance or stresses due to the primary system (for example temperature, flows).

The invention is not limited to the embodiments described hereinabove and extends to all of the embodiments covered by the claims.

REFERENCES

1. Source
10. Attenuation device
11. Acoustic absorber
12. Membrane
13. First face
14. Second face
15. Acoustic coupler with the first face
16. Coupling element
17. Acoustic coupler with the second face
18. Electro-acoustic coupler
19. Loudspeaker
20. Microphone
21. Cover
22. Static pressure balancing capillary
23. Loudspeaker control
24. Coupling chamber with the first face
25. Coupling chamber with the second face
30. Enclosure
40. Caisson
41. Sealed partition
50. Room
51. Upper wall
60. False ceiling
70. Intermediate space
151. Inlet of the acoustic coupler

152. Outlet of the acoustic coupler

171. Inlet of the acoustic coupler

172. Outlet of the acoustic coupler

100. System

The invention claimed is:

1. An attenuation device intended for attenuating sound waves generated by a source emitting sound waves of which the frequencies are between f1 and f2 and of which the pressure levels are between n1 and n2, the attenuation device comprising at least one acoustic absorber comprising at least one membrane, with the acoustic absorber having at least one first face and at least one second face separate from the first face, with the acoustic absorber being configured to have a behavior in non-linear deformation when it receives sound waves of which the frequencies are between $f_01$ and $f_02$, with the range $f_01$-$f_02$ covering at least 50% of the range f1-f2 and of which the pressure levels are between n01 and n02, with the range $n_01$-$n_02$ covering at least 50% of the range n1-n2;

with the attenuation device being configured in such a way that the first face of the absorber is in acoustic communication with the source;

with the attenuation device being comprising at least one coupling element for coupling the second face with the source, the coupling element being configured to transmit to the second face a maximum of power for sound waves of which the frequencies are higher than f1 and configured to transmit to the second face sound waves of which:

the instantaneous acoustic pressure that is exerted on the second face is according to the instantaneous acoustic pressure of sound waves emitted by the source, the phase and/or the amplitude results in that IP1−P2I>k·IP1I during at least one portion of the operating cycle of the source, with P1 and P2 being the instantaneous acoustic pressures of the sound waves arriving respectively on the first and second faces at the same time and with k>0.2.

2. The device according to claim 1, wherein the coupling element is configured to transmit to the second face sound waves of which the phase and/or the amplitude result in that IP1−P21>k·IP1I during at least one portion of the operating cycle of the primary source, with k>0.5 and preferably k>1.

3. The device according to claim 1, wherein k>1.5, preferably k>1.8.

4. The device according to claim 1, wherein the at least one coupling element for coupling the second face with the source is configured to transmit to the second face sound waves of which the phase and/or the amplitude results in that IP1−P2I>k·IP1I during at least X % of the operating cycle of the source, with X=10.

5. The device according to claim 4, wherein X=30.

6. The device according to claim 1, wherein the sound absorber has a linear resonance frequency $f_{rl}$, with $f_{rl}$<f1.

7. The device according to claim 1, wherein the at least one coupling element for coupling the second face with the source is configured in such a way that the membrane reaches an acoustic pumping state, more preferably at least when the range of frequencies transmitted by the coupling element is for a portion higher than the frequency $f_{01}$ and more preferably higher than the frequency $f_{02}$.

8. The device according to claim 1, configured in such a way as to allow for a bi-directional communication between the source and said first face of the absorber.

9. The device according to claim 1, wherein at least one membrane is configured in such a way as to have a behaviour in non-linear deformation when it receives sound waves of which the frequencies are between $f_{01}$ and $f_{02}$, with the range $f_{01}$-$f_{02}$ covering at least 70% and more preferably 100% of the range f1-f2.

10. The device according to claim 1, wherein at least one membrane is configured in such a way as to have a behaviour in non-linear deformation when it receives sound waves of which the pressure levels are between $n_01$ and $n_02$, with the range $n_01$-$n_02$ covering at least 70% and more preferably 100% of the range n1-n2.

11. The device according to claim 1, wherein the coupling element for coupling the second face with the source comprises at least one acoustic duct.

12. The device according to claim 11, comprising a cover forming with said second face a closed volume except for an opening via said at least one acoustic duct.

13. The device according to claim 11, wherein said second face is housed in said at least one acoustic duct.

14. The device according to claim 1, wherein the coupling element comprises at least one internal wall and at least one acoustically absorbent element arranged on the internal wall.

15. The device according to claim 1, wherein the acoustically absorbent elements are configured to absorb in part at least the high frequencies produced by the source and/or by the attenuation device.

16. The device according to claim 14, wherein the at least one acoustically absorbent element is glass wool.

17. The device according to claim 1, wherein the coupling element for coupling the second face with the source comprises at least one electro-acoustic coupler.

18. The device according to claim 17, wherein the electro-acoustic coupler comprises at least one loudspeaker and wherein at least one membrane is a membrane of the loudspeaker.

19. The device according to claim 18, wherein an external face of the membrane of the loudspeaker is said first face.

20. The device according to claim 18, wherein the absorber is configured in such a way that the loudspeaker receives an electric signal according to an acoustic signal of the source.

21. The device according to claim 20, wherein the absorber comprises a microphone arranged to capture sound waves coming from the source and is configured in such a way that said acoustic signal is provided by the microphone.

22. The device according to claim 21, comprising a cover defining with said second face a closed volume except for a capillary for balancing static pressures in said first face and said second face.

23. The device according to claim 18, wherein the absorber is configured in such a way as to receive an acoustic signal taken on the second face of the membrane.

24. The device according to claim 23, comprising a cover defining with said second face a closed volume except for a duct forming an acoustic coupling between said second face and the source.

25. The device according to claim 1, wherein the attenuation device comprises a plurality of coupling elements of the second face with the source.

26. The device according to claim 1, wherein the attenuation device is configured in such a way that the acoustic communication between the source and said first face of the absorber is a direct acoustic coupling without any intermediate element for transmitting the sound.

27. The device according to claim 26, wherein the attenuation device comprises an enclosure configured to house the source and the acoustic absorber, with the attenuation device being configured in such a way that the first face of the absorber is in acoustic communication with the source via the internal volume of the enclosure.

28. The device according to claim 1, wherein the attenuation device is configured in such a way that the acoustic communication between the source and said first face of the absorber is an acoustic coupling carried out in part at least by one or several acoustic ducts.

29. The device according to claim 1, wherein the coupling element for coupling the second face with the source has several resonance frequencies.

30. The device e according to claim 1, wherein the first and second faces of the absorber extend in parallel planes.

31. The device according to claim 1, wherein the first and second faces of the absorber are linked mechanically.

32. A system comprising a source emitting sound waves wherein the frequencies are between f1 and f2 and wherein the pressure levels are between n1 and n2 and an attenuation device according to claim 1 configured to attenuate the sound waves of said source.

33. An attenuation method intended for attenuating sound waves generated by a source emitting sound waves wherein the frequencies are between f1 and f2 and wherein the pressure levels are between n1 and n2, wherein the method comprises the following steps:

selecting at least one acoustic absorber comprising at least one membrane, with the acoustic absorber having at least one first face and at least one second face separate from the first face, with the acoustic absorber being configured to have a behaviour in non-linear deformation when it receives sound waves of which the frequencies are between $f_0 1$ and $f_0 2$, with the range $f_0 1$-$f_0 2$ covering at least 50% of the range f1-f2 and of which the pressure levels are between $n_0 1$ and $n_0 2$, with the range $n_0 1$-$n_0 2$ covering at least 50% of the range n1-n2;

arranging the first face of the absorber in acoustic communication with the source;

selecting a coupling element for coupling the second face with the source, the coupling element being selected in such a way as to transmit to the second face a maximum of power for sound waves of which the frequencies are higher than f1 and configured to transmit to the second face sound waves of which:

the instantaneous pressure that is exerted on the second face is according to the instantaneous pressure of the sound waves emitted by the source, the phase and/or the amplitude results in that $|P1-P2| > k \cdot |P1|$ during at least one portion of the operating cycle of the source, with P1 and P2 being the instantaneous pressures of the sound waves arriving respectively on the first and second faces at the same time and with $k>0.2$.

34. A method according to claim 33, wherein the at least one coupling element for coupling the second face with the source is configured to transmit to the second face sound waves wherein the phase and/or the amplitude results in that $|P1-P2| > k \cdot |P1|$ during at least X % of the operating cycle of the source, with X=10.

* * * * *